US011415926B1

(12) United States Patent
Doi

(10) Patent No.: US 11,415,926 B1
(45) Date of Patent: Aug. 16, 2022

(54) FIXING DEVICE AND IMAGE FORMING APPARATUS

(71) Applicant: TOSHIBA TEC KABUSHIKI KAISHA, Tokyo (JP)

(72) Inventor: Yohei Doi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/163,704

(22) Filed: Feb. 1, 2021

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01); *G03G 15/2053* (2013.01)

(58) Field of Classification Search
CPC . G03G 15/80; G03G 15/2039; G03G 15/2053
USPC ..... 399/329, 45
See application file for complete search history.

(56) References Cited

U.S. PATENT DOCUMENTS 5,115,279 A * 5/1992 Nishikawa ..... G03G 15/2053 399/331
2005/0047809 A1* 3/2005 Kunimori ..... G03G 15/205 399/45
2015/0331372 A1 11/2015 Takagi
2016/0070225 A1* 3/2016 Akiyama ..... H05B 1/0241 219/535

FOREIGN PATENT DOCUMENTS

JP H0535149 2/1993
JP 2006-010989 1/2006

* cited by examiner

*Primary Examiner* — Arlene Heredia
(74) *Attorney, Agent, or Firm* — Foley & Lardner LLP

(57) ABSTRACT

A fixing device includes a plurality of heating elements, a plurality of first terminals, a second terminal, a movable member, a first conductive circuit and a second conductive circuit. The heating elements are arranged in a main scanning direction and generate heat. The first terminals are electrically connected to the heating elements. The second terminal is electrically connected to a power supply that supplies electric power to the heating elements. The first conductive circuit and the second conductive circuit are provided on a surface of the movable member. The first conductive circuit is configured to electrically connect a first combination of one or more of the first terminals with the second terminal. The second conductive circuit is configured to electrically connect a different, second combination of one or more of the first terminals with the second terminal.

15 Claims, 10 Drawing Sheets

FIXING DEVICE AND IMAGE FORMING APPARATUS

FIELD

Embodiments described herein relate generally to a fixing device and an image forming apparatus.

BACKGROUND

In the related art, in a fixing device of an image forming apparatus, a heating region is divided into a plurality of regions. Heaters are individually arranged in each of the divided subregions, and an independent heating control circuit (for example, a triac) is provided for the heater in each subregion. According to the employment of such a configuration, it is possible to heat a region suitable for each of a plurality of sheet sizes.

However, the number of subregions (i.e., the number of divisions of the heating region) increases according to the sheet size. Therefore, the configuration of the fixing device can become complicated when handling larger sheets, and the number of parts (for example, the number of heating control circuits) may increase accordingly.

DETAILED DESCRIPTION

In general, according to one embodiment, a fixing device includes a plurality of heating elements, a plurality of first terminals, a second terminal, a movable member, a first conductive circuit, a second conductive circuit, a thin film, and a rotating body. The heating elements are arranged in a main scanning direction and generate heat. The first terminals are electrically connected to the heating elements. The second terminal is electrically connected to a power supply that supplies electric power to the heating elements. The first conductive circuit and the second conductive circuit are provided on a surface of the movable member. The thin film is a strip-like thin film that slides on a heating element surface while being in contact with the heating element on one surface thereof. The rotating body is able to press the other surface of the thin film and be rotationally driven. The first conductive circuit is configured to electrically connect a first combination of one or more of the first terminals with the second terminal. The second conductive circuit is configured to electrically connect a second combination of one or more of the first terminals with the second terminal. The first combination is different from the second combination.

Figure 1:
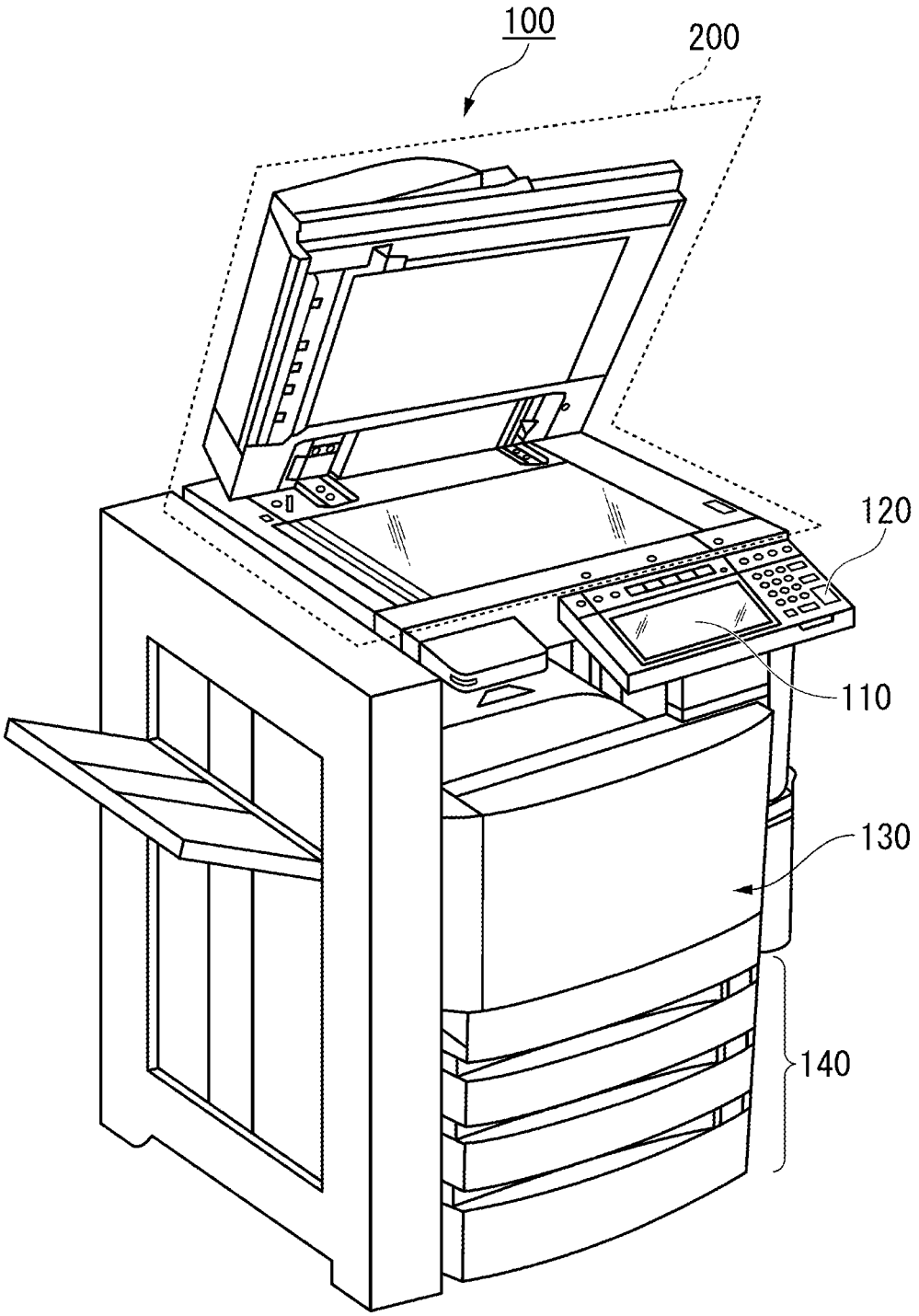
FIG. 1 is an external view illustrating an overall configuration example of an image forming apparatus according to an embodiment.
Figure 2:
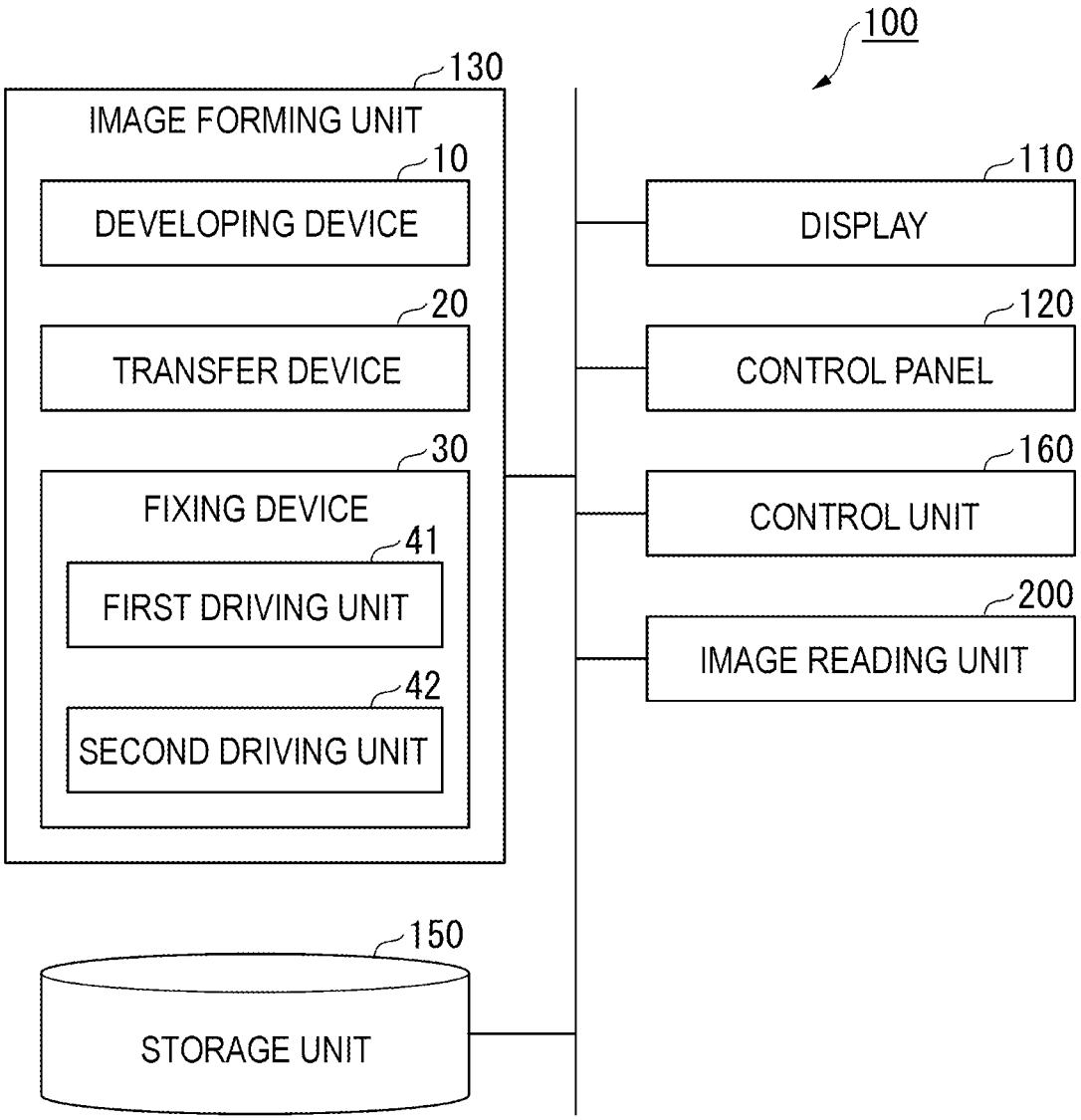
FIG. 2 is a hardware block diagram of the image forming apparatus according to the embodiment.

Hereinafter, a fixing device and an image forming apparatus of the embodiment will be described with reference to the drawings. FIG. 1 is an external view illustrating an overall configuration example of an image forming apparatus 100 according to the embodiment. FIG. 2 is a hardware block diagram of the image forming apparatus 100 according to the embodiment. The image forming apparatus 100 is, for example, a multifunction peripheral. The image forming apparatus 100 includes a display 110 (e.g., a user interface), a control panel 120 (e.g., a user interface), an image forming unit 130, a sheet containing unit 140, and an image reading unit 200.

The image forming apparatus 100 forms an image on a sheet with a developer such as a toner. The developer is heated to be fixed onto the sheet. The sheet is, for example, paper or label paper. Anything can be used as the sheet as long as the image forming apparatus 100 can form an image on the surface thereof.

The display 110 is an image display device such as a liquid crystal display or an organic electro luminescence (EL) display. The display 110 displays various kinds of information relating to the image forming apparatus 100.

The image forming unit 130 forms an image on the sheet based on image information generated by the image reading unit 200 or image information received via a communication path. The image forming unit 130 includes, for example, a developing device 10, a transfer device 20, and a fixing device 30. The image forming unit 130 forms an image, for example, by a process as follows. The developing device 10 of the image forming unit 130 forms an electrostatic latent image on a photoconductor drum based on image information. The developing device 10 of the image forming unit 130 fixes the developer onto the electrostatic latent image to form a visible image (e.g., a toner image). Specific examples of the developer include a toner. Examples of the toner include a decolorable toner, a non-decolorable toner (e.g., ordinary toner), and a decorative toner.

The transfer device 20 of the image forming unit 130 transfers the visible image to the sheet. The fixing device 30 of the image forming unit 130 heats and pressurizes the sheet to fix the visible image to the sheet. The sheet on which the image is formed may be a sheet stored in the sheet storage unit 140 or may be a sheet manually fed.

The sheet storage unit 140 stores a sheet to be used for forming an image in the image forming unit 130.

A storage unit 150 (e.g., memory) is configured by using a storage device such as a magnetic hard disk device or a semiconductor storage device. The storage unit 150 stores data required when the image forming apparatus 100 operates. The storage unit 150 may temporarily store data of the image formed in the image forming apparatus 100.

A control unit 160 is configured by using a processor such as a central processing unit (CPU) and a memory. The control unit 160 reads and executes a program stored in advance in the storage unit 150. The control unit 160 controls the operation of each device included in the image forming apparatus 100.

The image reading unit 200 (e.g., a scanner) reads image information to be read based on brightness and darkness of light. The image reading unit 200 records the read image information. The recorded image information may be transmitted to another information processing device via a network. The recorded image information may be formed as an image on the sheet by the image forming unit 130. The image reading unit 200 may include automatic document feeding (ADF).

Figure 3:
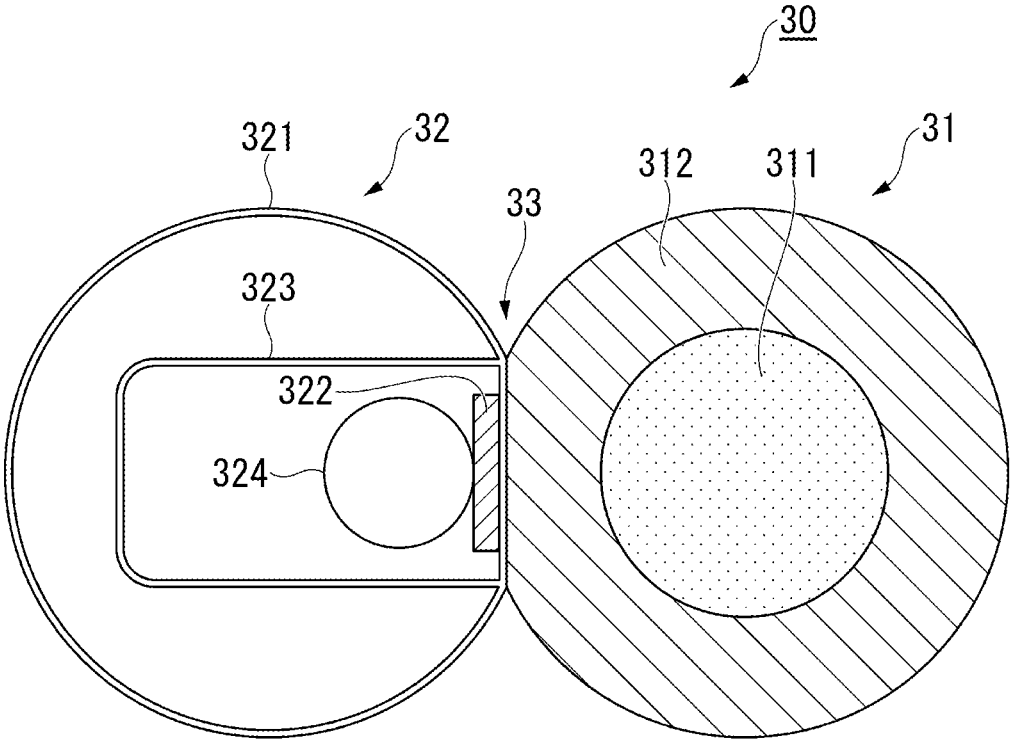
FIG. 3 is a front sectional view of a fixing device according to the embodiment.

FIG. 3 is a front sectional view of the fixing device 30 according to the embodiment. The fixing device 30 of the embodiment includes a pressure roller 31 and a film unit 32.

The pressure roller 31 is configured to be able to press the surface against the film unit 32 and be rotationally driven. If the surface of the pressure roller 31 is pressed against the film unit 32, the pressure roller 31 forms a nip 33 with the film unit 32. The pressure roller 31 pressurizes a visible image of the sheet that enters the nip 33. If the pressure roller 31 is rotationally driven, the sheet is conveyed according to the rotation. The pressure roller 31 includes, for example, a core metal 311 (e.g., a metal core) and an elastic layer 312.

The core metal 311 is formed in a columnar shape by a metal material such as stainless steel. Both ends of the core metal 311 in the axial direction are rotatably supported (e.g., by bearings coupled to housing of the image forming apparatus 100). The core metal 311 is rotationally driven by a first driving unit 41 (e.g., an electric motor, a driver, an actuator, etc.). The first driving unit 41 is a device driven by electric power and is configured by using, for example, a motor. The first driving unit 41 is driven, for example, according to a control signal output from the control unit 160.

The elastic layer 312 is formed of an elastic material such as silicone rubber. The elastic layer 312 is formed on the outer peripheral surface of the core metal 311 in a constant thickness. A release layer is formed on the outer peripheral surface of the elastic layer 312. The release layer is formed, for example, of a resin material such as PFA (e.g., tetrafluoroethylene-perfluoroalkyl vinyl ether copolymer). The hardness of the outer peripheral surface of the pressure roller 31 is preferably 40° to 70° under a load of 9.8 N with an ASKER-C hardness tester. As a result, the area of the nip 33 and the durability of the pressure roller 31 are ensured.

The pressure roller 31 is rotationally driven by the power of the first driving unit 41. If the pressure roller 31 rotates in a state in which the nip 33 is formed, a cylindrical film 321 of the film unit 32 is driven to rotate. The pressure roller 31 rotates in a state in which the sheet is disposed at the nip 33, so that the sheet is conveyed in the conveyance direction.

The film unit 32 heats the visible image of the sheet that enters the nip 33. The film unit 32 includes the cylindrical film 321 (e.g., a cylindrical body), a heater unit 322 (e.g., a heater), a stay 323 (e.g., a support, a frame, etc.), and a movable member 324.

The cylindrical film 321 is formed in a cylindrical shape. The cylindrical film 321 includes a base layer, an elastic layer, and a release layer in this order from the inner peripheral side. The base layer is formed in a cylindrical shape by a material such as nickel (Ni). The elastic layer is laminated on the outer peripheral surface of the base layer. The elastic layer is formed of an elastic material such as silicone rubber. The release layer is laminated on the outer peripheral surface of the elastic layer. The release layer is formed of a material such as PFA resin. The cylindrical film 321 is a strip-like thin film that slides on the surface of the heater unit 322 while being in contact with the heater unit 322 on one surface thereof.

Figure 4:
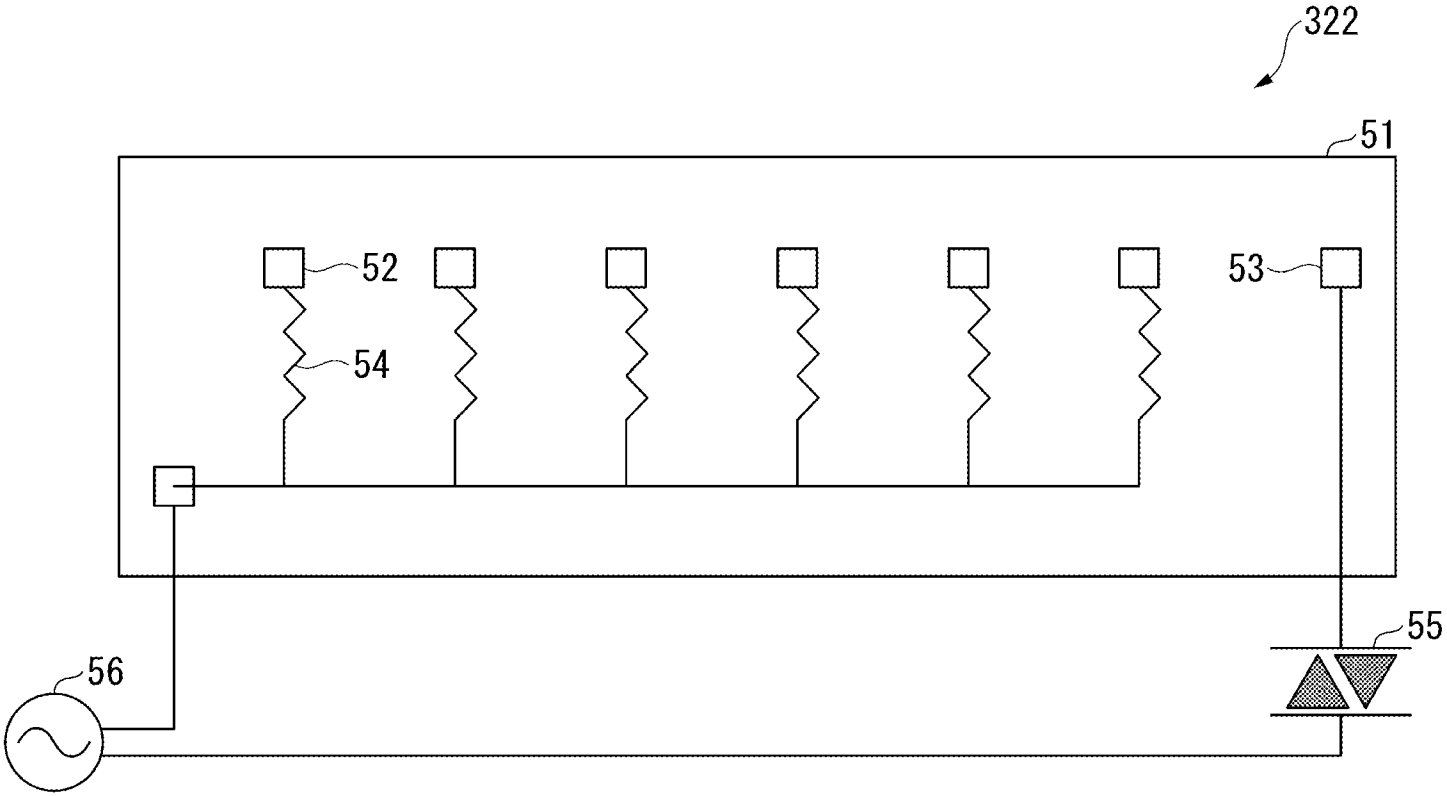
FIG. 4 is a diagram illustrating a specific example of a heater unit.

FIG. 4 is a diagram illustrating a specific example of the heater unit 322. The heater unit 322 includes a substrate 51 (e.g., a heating element substrate), a plurality of first terminals 52, a second terminal 53, a plurality of heating elements 54, and a heating control circuit 55. The heater unit 322 is connected to a power supply 56.

The substrate 51 is formed of a metal material such as stainless steel or nickel, a ceramic material such as aluminum nitride, or the like. The substrate 51 is formed, for example, in an elongated rectangular plate shape. The substrate 51 is disposed on the inner side in the radial direction of the cylindrical film 321. The substrate 51 has the axial direction of the cylindrical film 321 as the longitudinal direction.

The first terminals 52 are provided on the substrate 51 and connected to at least one of the heating elements 54 (e.g., heaters). The first terminals 52 are configured to be in contact with third terminals 61 provided on the movable member 324 and electrically connected to the third terminals 61.

The second terminal 53 is provided on the substrate 51 and is connected to the heating control circuit 55. The second terminal 53 is configured to be in contact with fourth terminals 62 provided in the movable member 324 and electrically connected to the fourth terminals 62. If the first terminals 52 and the second terminal 53 are electrically connected to the third terminals 61 and the fourth terminals 62 respectively, an electric circuit including the heating control circuit 55, one or a plurality of heating elements 54, and the power supply 56 is formed. In this case, under the control by the heating control circuit 55, the electric power is supplied from the power supply 56 to one or a plurality of heating elements 54 included in the formed electric circuit.

One end of the heating element 54 is connected to the first terminal 52, and the other end is connected to the power supply 56. The plurality of heating elements 54 are arranged on the substrate 51 in the main scanning direction. The heating element 54 generates heat by energization. The heating element 54 is formed by using a heating resistor such as a silver-palladium alloy. The heating resistor used in the heating element 54 may be configured by using a material of which a resistance value greatly changes according to the temperature. Specifically, the heating resistor may be configured by using a material having a lower resistance value as the temperature is lower and a higher resistance value as the temperature is higher. For example, the heating element 54 may be configured, for example, by using a PTC element.

The heating control circuit 55 is supplied to a part or the entire part of the electric power output from the power supply 56 to the heating elements 54 according to the control of the control unit 160. The heating control circuit 55 may be configured by using a semiconductor switching element such as a triac.

The description is made referring back to FIG. 3. The stay 323 (e.g., a support, a frame member, etc.) is formed by using a steel plate material or the like. The cross section of the stay 323 may be formed, for example, in a U shape. Both ends of the stay 323 in the longitudinal direction are fixed to the housing of the image forming apparatus 100. As a result, the film unit 32 is supported by the image forming apparatus 100.

Figure 5:
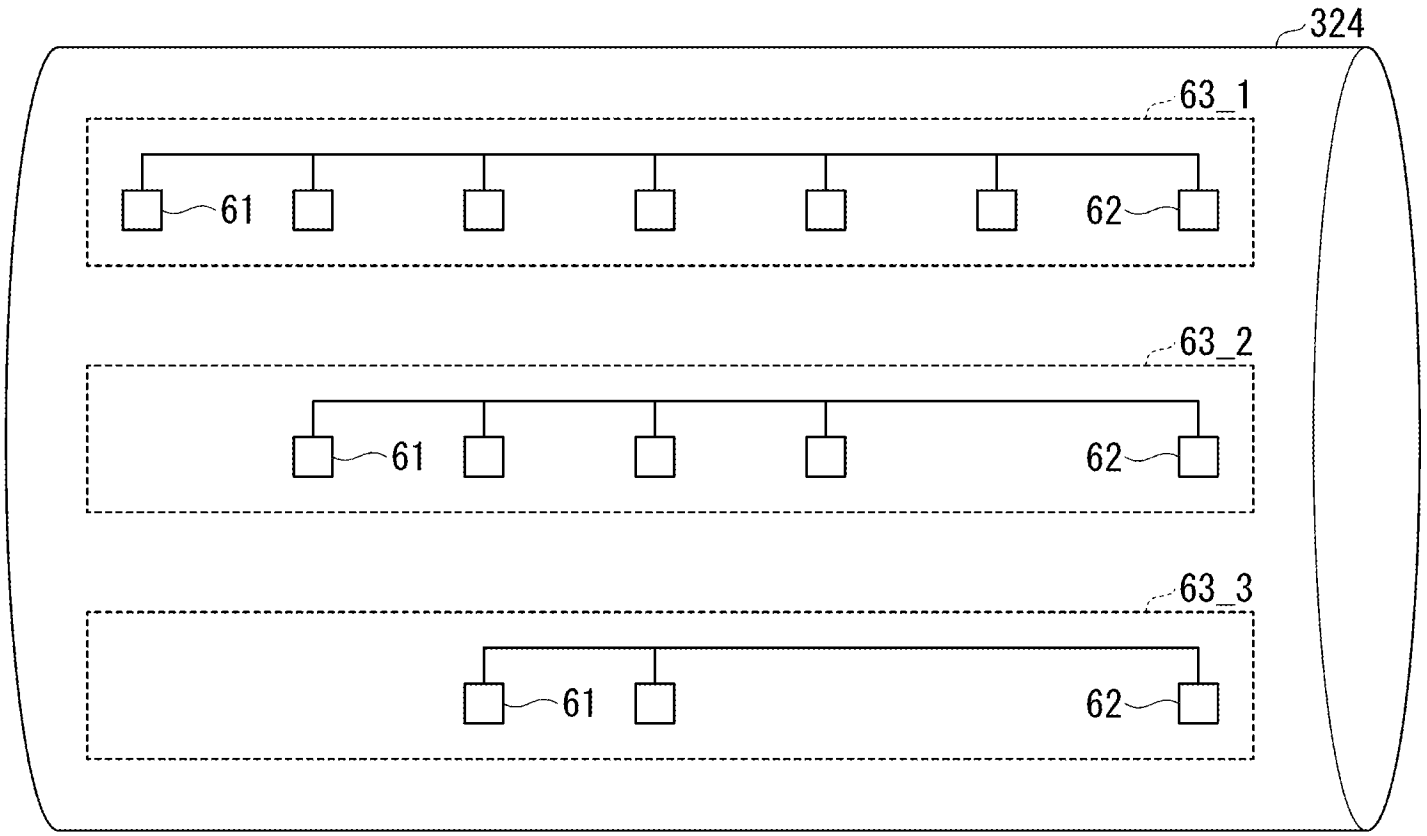
FIG. 5 is a diagram illustrating a specific example of a movable member.

The movable member 324 is configured to be moved by a driving force of a second driving unit 42 (e.g., an electric motor, a driver, an actuator, etc.) and be able to change the position for contact with the heater unit 322. FIG. 5 is a diagram illustrating a specific example of the movable member 324. A plurality of circuit patterns 63 (for example, 63_1, 63_2, and 63_3) are formed on the surface of the movable member 324. Each of the circuit patterns 63 includes one or a plurality of third terminals 61 and the fourth terminal 62. In each of the circuit patterns 63, one or a plurality of third terminals 61 and the fourth terminal 62 are connected by a conducting wire to be electrically connected.

In each of the circuit patterns 63, the combination of positions where the third terminals 61 are provided is different. For example, the circuit pattern 63_1 (e.g., a first conductive circuit) has six third terminals 61 arranged at the same interval. For example, the circuit pattern 63_2 has four third terminals 61 arranged at the same interval. For example, the circuit pattern 63_3 (e.g., a second conductive circuit) has two arranged third terminals 61. As another specific example of the circuit patterns 63, for example, a part of the plurality of third terminals 61 may be disposed at a different interval. However, if the circuit patterns 63 are selected, each of the third terminals 61 of the circuit patterns 63 is disposed to be in contact with the first terminals 52. If the circuit patterns 63 are selected, each of the fourth terminals 62 of the circuit patterns 63 is disposed to be in contact with the second terminal 53.

In the specific example of FIG. 5, the movable member 324 has a cylindrical shape and each of the circuit patterns 63 is formed on a curved surface. Since the movable member 324 rotates according to the driving force of the second driving unit 42, the position of the curved surface in contact with the substrate 51 changes. The heating element 54 to be activated to generate heat is selected by the control unit 160 and the circuit pattern 63 is selected corresponding to the first terminal 52 of the selected heating element 54. The movable member 324 is moved so that the third terminals 61 and the fourth terminal 62 of the selected circuit pattern are in contact with the first terminals 52 and the second terminal 53 of the substrate 51.

Figure 6:
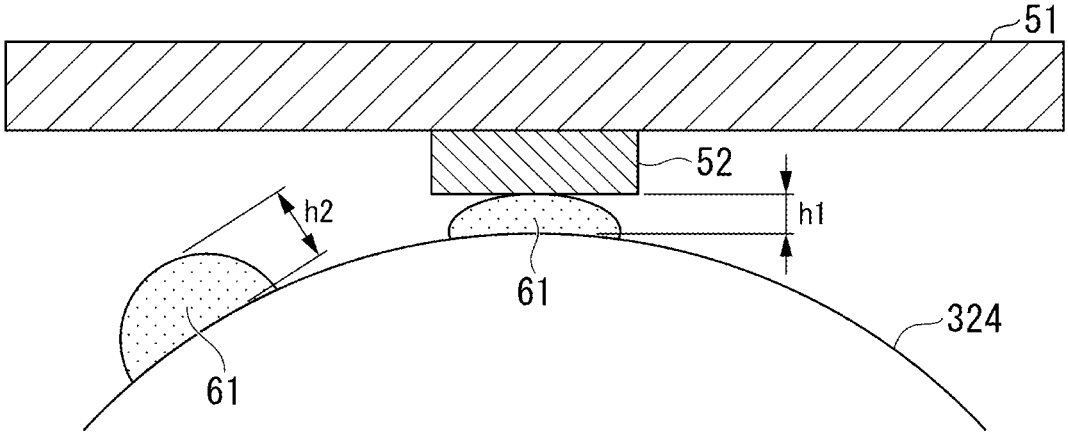
FIG. 6 is a diagram illustrating an example of cross-sections of the heater unit and the movable member.

FIG. 6 is a diagram illustrating an example of cross sections of the heater unit 322 and the movable member 324. The third terminals 61 and the fourth terminal 62 receive a biasing force on the surface of the movable member 324 in a direction away from the movable member 324. This biasing force may be a force generated, for example, according to the materials or shapes of the third terminals 61 and the fourth terminal 62. This biasing force may be a force generated, for example, by an elastic body provided between the third terminals 61 and the fourth terminal 62, and the movable member 324.

For example, in the example of FIG. 6, the height of the third terminal 61 that is in contact with the first terminal 52 is h1 and the height of the third terminal 61 that is not in contact with the first terminal 52 is h2. The third terminal 61 that is not in contact with the first terminal 52 maintains the height of h2 which is higher than h1 according to the biasing force. Meanwhile, the third terminal 61 that is in contact with the first terminal 52 receives the force from the first terminal 52 toward the movable member 324 to be pressed to the position of the lower height h1. By the generation of the biasing force, the first terminal 52 and the third terminal 61 are securely in contact with each other, and electrical connection can be maintained.

Figure 7:
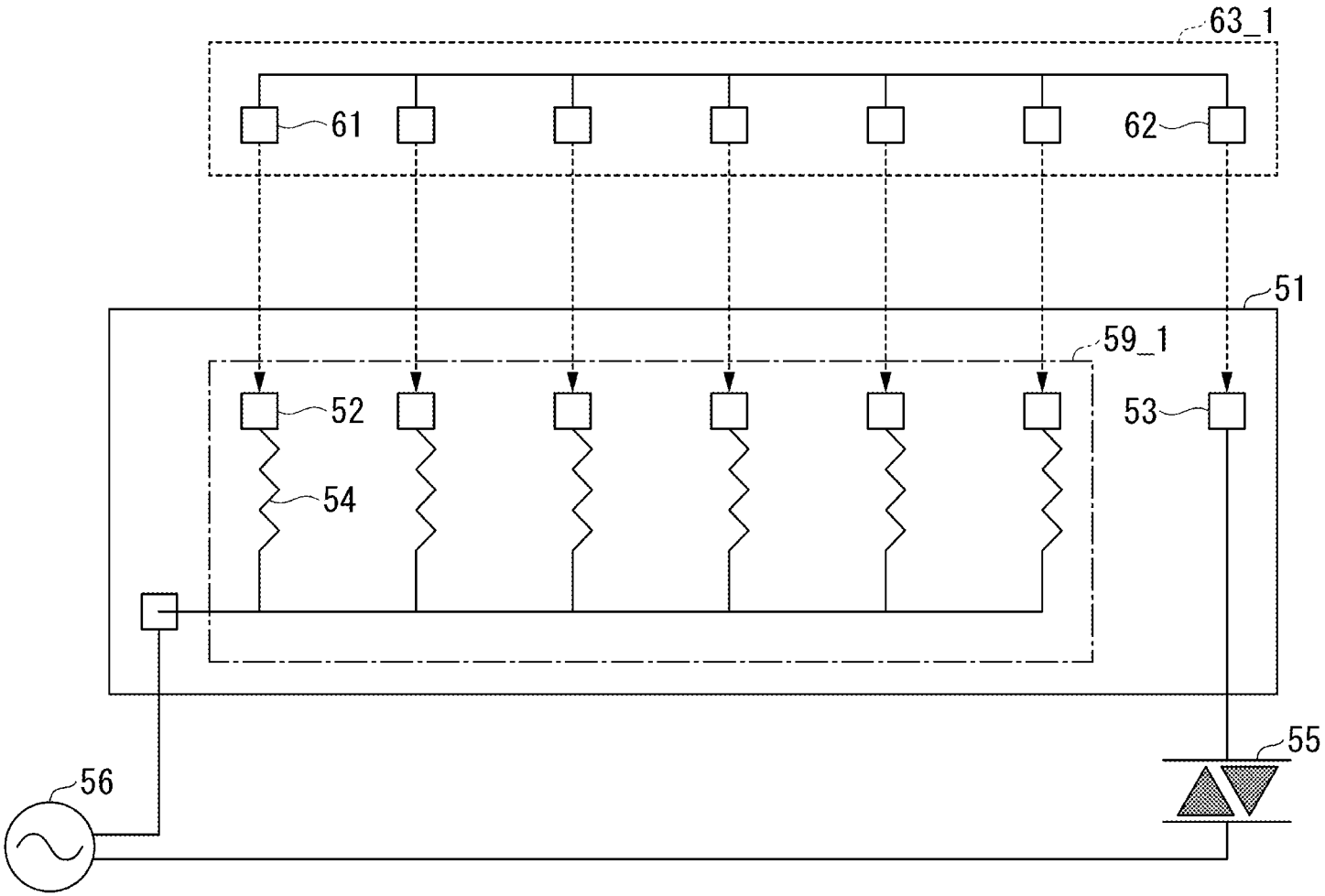
FIG. 7 is a diagram illustrating a specific example of a selected circuit pattern.

FIG. 7 is a diagram illustrating a specific example of the selected circuit pattern 63. In FIG. 7, the circuit pattern 63_1 is selected. The six third terminals 61 of the selected circuit pattern 63_1 are in contact with the first terminals 52, respectively. The fourth terminal 62 of the selected circuit pattern 63_1 is in contact with the second terminal 53. According to this contact, the six heating elements 54 are connected to the power supply 56 via the heating control circuit 55. By the formation of the circuit, the electric power is supplied from the power supply 56 to the six heating elements 54 and the heat is generated. Therefore, in a heat generating region 59_1 illustrated with the alternate long and short dash line in FIG. 7, heat for fixing is generated.

Figure 8:
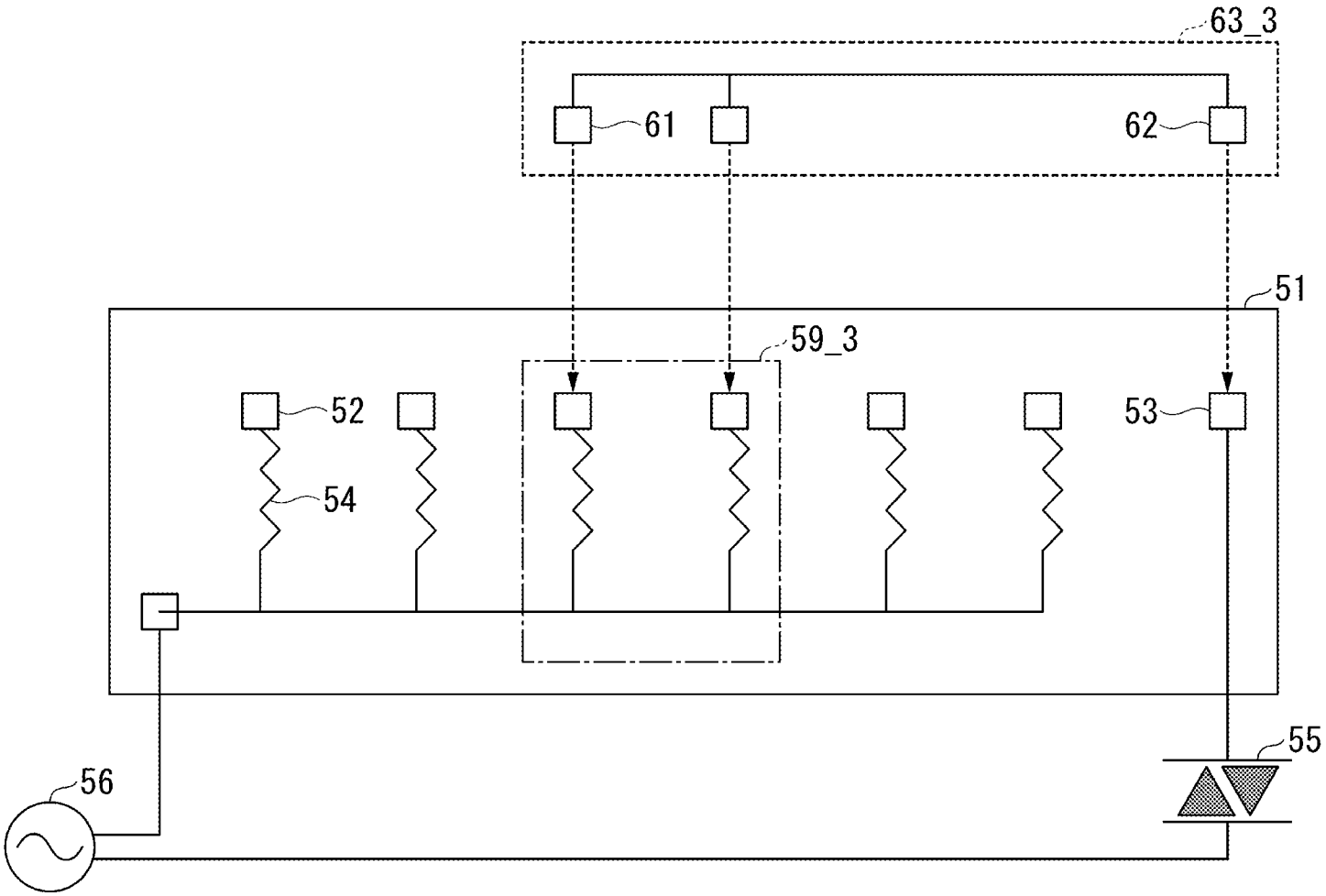
FIG. 8 is a diagram illustrating a specific example of the selected circuit pattern.

FIG. 8 is a diagram illustrating a specific example of the selected circuit pattern 63. In FIG. 8, the circuit pattern 63_3 is selected. The two third terminals 61 of the selected circuit pattern 63_3 are in contact with the first terminals 52, respectively. The fourth terminal 62 of the selected circuit pattern 63_3 is in contact with the second terminal 53. According to this contact, the two heating elements 54 are connected to the power supply 56 via the heating control circuit 55. By the formation of the circuit, the electric power is supplied from the power supply 56 to the two heating elements 54 and the heat is generated. Therefore, in a heat generating region 59_3 illustrated with the alternate long and short dash line in FIG. 8, heat for fixing is generated. As illustrated in FIGS. 7 and 8, the heat generating regions 59 change according to the selected circuit patterns 63.

Figure 9:
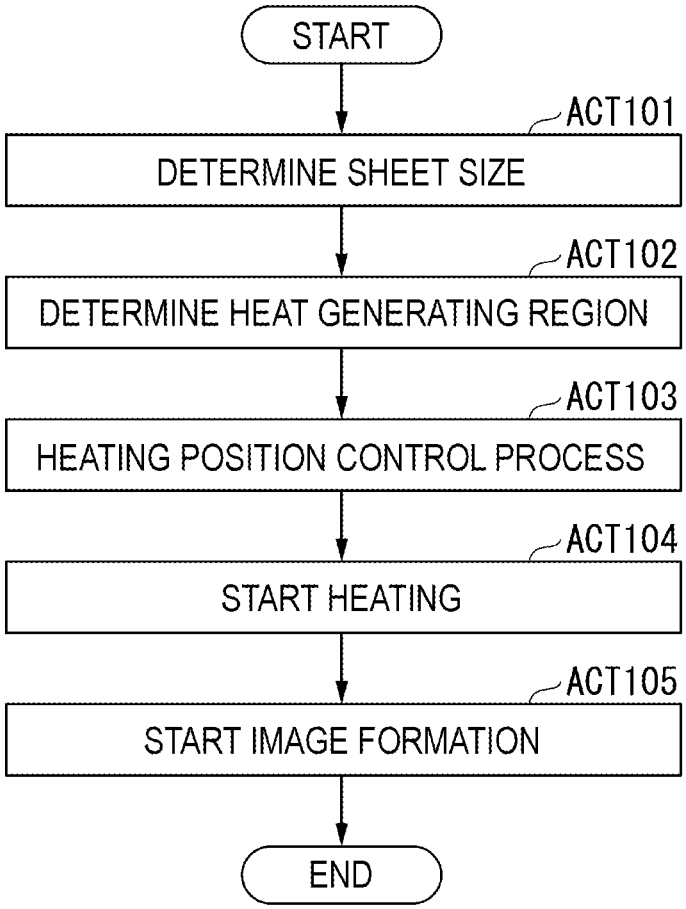
FIG. 9 is a flowchart illustrating a specific example of the processing of a control unit.

FIG. 9 is a flowchart illustrating a specific example of the processing of the control unit 160. The control unit 160 determines a sheet size in accordance with the received image forming data or an operation in the control panel 120 (ACT 101). The control unit 160 determines the heat generating region 59 based on the determined sheet size (ACT 102). For example, a table in which the heat generating regions 59 are determined for each sheet size may be registered in the storage unit 150 in advance. In this case, the control unit 160 may determine the heat generating region 59 based on the table registered in the storage unit 150.

The control unit 160 executes a heating position control process corresponding to the determined heat generating region 59 (ACT 103). In the heating position control process, the control unit 160 drives the second driving unit 42 to move the movable member 324 so that the circuit pattern 63 is in contact with the heater unit 322 corresponding to the determined heat generating region 59. If the movement of the movable member 324 is completed, the control unit 160 supplies the electric power to the heating elements 54 by the control of the heating control circuit 55 and starts heating (ACT 104). If the measured value of the temperature of the heat generating region 59 exceeds a threshold value determined in advance, the control unit 160 starts image formation by controlling the developing device 10 and the transfer device 20 (ACT 105).

In the image forming apparatus 100 of the embodiment configured in this manner, only one open circuit of one pattern is formed in the heater unit 322. According to the selection of the heat generating region 59, one circuit pattern 63 is selected from the plurality of circuit patterns 63 formed in the movable member 324. Also, since each terminal of the selected circuit pattern 63 comes in contact with each terminal of the heater unit 322, a closed circuit is formed in the heater unit 322. Also, the electric power from the power supply 56 is supplied only to the heating element 54 included in the closed circuit, and the generation of the heat starts. Therefore, the circuit separated into a plurality of parts in the heater unit 322 becomes unnecessary. As a result, the number of heating control circuits 55 can be reduced (for example, to one) and the number of parts can be reduced in the configuration of the fixing device. In addition, ON/OFF switching control for each of the circuits divided into plural becomes unnecessary and firmware control can be simplified.

MODIFICATION

Figure 10:
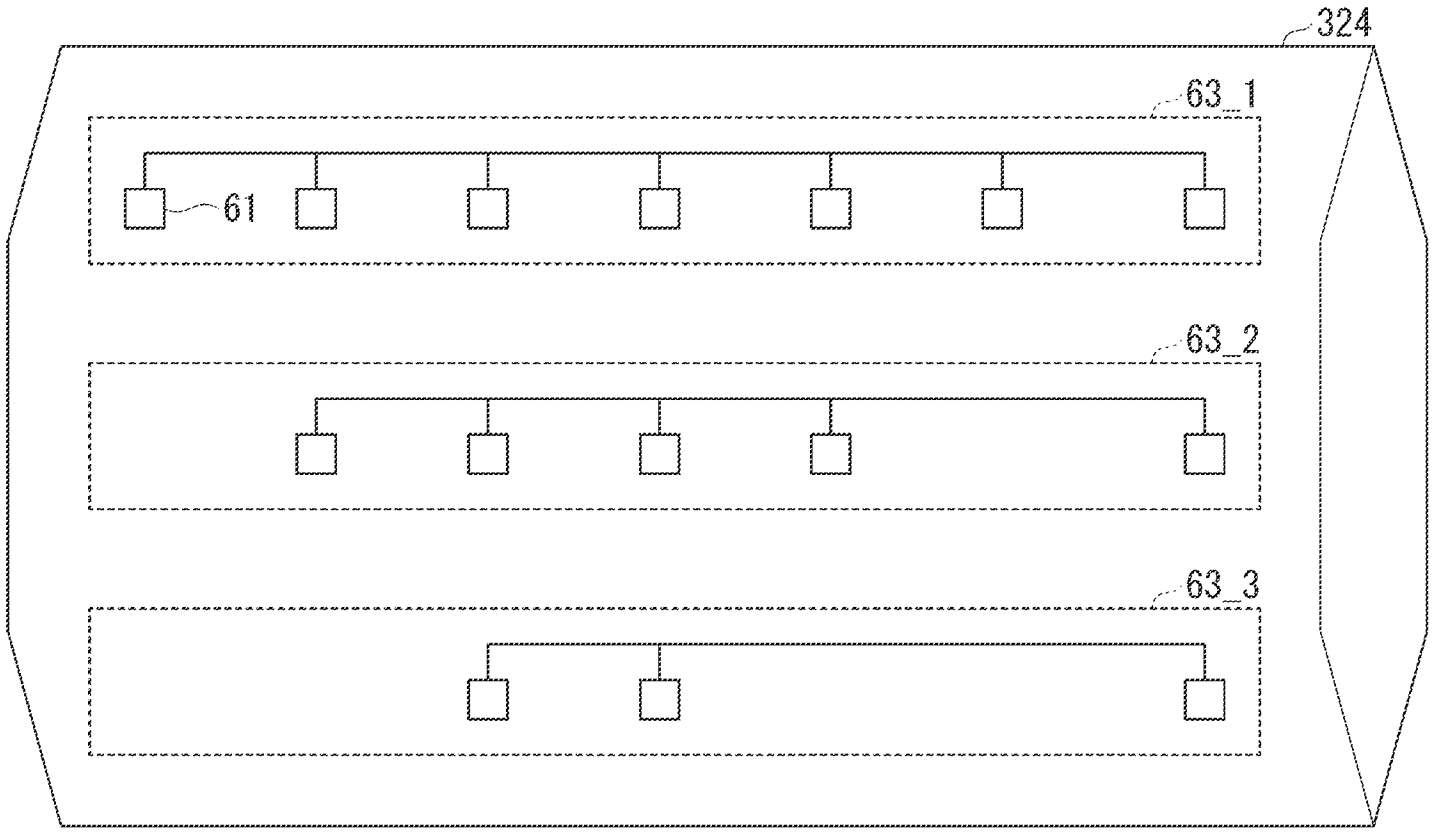
FIG. 10 is a diagram illustrating a configuration of a modification of the movable member.

FIG. 10 is a diagram illustrating a configuration of a modification of the movable member 324. In the embodiment described above, the movable member 324 as illustrated in FIG. 5 is configured in a cylindrical shape. However, the shape of the movable member 324 is not required to be limited to a cylinder. For example, as illustrated in FIG. 10, the movable member 324 may be configured by using a polygonal columnar object. In the example of FIG. 10, the movable member 324 is formed in a hexagonal column shape. Further, the movable member 324 does not necessarily have to be formed in a columnar shape and may be configured by using, for example, a flat plate. In this case, the surface of the flat plate may be divided into a plurality of regions and the different circuit patterns 63 may be formed in each region. In this case, the second driving unit 42 may bring the selected circuit pattern 63 into contact with the heater unit 322 by moving the flat plate.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device comprising:

a plurality of heaters arranged in a main scanning direction and configured to generate heat;

a plurality of first terminals electrically connected to the heaters;

a second terminal electrically connected to a power supply that supplies electric power to the heaters;

a movable member;

a first conductive circuit and a second conductive circuit provided on a surface of the movable member, wherein:

the first conductive circuit is configured to electrically connect a first combination of one or more of the first terminals with the second terminal, the first conductive circuit including:

at least one third terminal configured to contact at least one of the first terminals;

a fourth terminal configured to contact the second terminal; and a conducting wire electrically connecting the at least one third terminal and the fourth terminal;

the second conductive circuit is configured to electrically connect a second combination of one or more of the first terminals with the second terminal; and the first combination is different from the second combinations;

a film configured to slide relative to the heaters, the film including a first film surface in contact with at least one of the heaters; and a rotating body positioned to press a second film surface of the film and configured to be rotationally driven.

2. The fixing device of claim 1, wherein:

the first conductive circuit is configured to activate one or more of the heaters corresponding to a first shape of sheet on which an image is formed; and the second conductive circuit is configured to activate one or more of the heaters corresponding to a second shape of sheet on which an image is formed.

3. The fixing device of claim 1, further comprising:

a heating control circuit connected to a circuit including the plurality of first terminals, the second terminal, and the plurality of heaters.

4. The fixing device of claim 3, wherein the heating control circuit is provided between the second terminal and the power supply.

5. The fixing device of claim 1, wherein:

the movable member has a columnar shape.

6. The fixing device of claim 1, further comprising:

an actuator configured to rotate the movable member to selectively bring the first conductive circuit or the second conductive circuit into contact with the second terminal.

7. An image forming apparatus comprising:

a fixing device including:

a plurality of heaters arranged in a main scanning direction and configured to generate heat;

a plurality of first terminals electrically connected to the heaters;

a second terminal electrically connected to a power supply that supplies electric power to the heaters;

a movable member;

a first conductive circuit and a second conductive circuit provided on a surface of the movable member;

a driver configured to drive the movable member;

a film configured to slide relative to the heaters, the film having a first film surface in contact with at least one of the heaters; and a rotating body positioned to press a second film surface of the film and configured to be rotationally driven; and a processor configured to control the driver such that at least one of:

a third terminal and a fourth terminal of the first conductive circuit are in contact with one of the first terminals and the second terminal, respectively; or a third terminal and a fourth terminal of the second conductive circuit are in contact with one of the first terminals and the second terminal, respectively, wherein:

the first conductive circuit is a configured to electrically connect a first combination of one or more of first terminals with the second terminal;

the second conductive circuit is configured to electrically connect a second combination of one or more of the first terminals with the second terminal; and the first combination is different from the second combination.

8. The image forming apparatus of claim 7, wherein the processor is configured to control the driver based on a shape of a sheet on which an image is to be formed.

9. The image forming apparatus of claim 8, wherein the processor is configured to control the driver to electrically connect the first conductive circuit or the second conductive circuit based on the shape of the sheet.

10. A fixing device comprising:

a plurality of heaters arranged in a main scanning direction and configured to generate heat;

a plurality of first terminals electrically connected to the heaters;

a second terminal electrically connected to a power supply that supplies electric power to the heaters;

a movable member;

a first conductive circuit and a second conductive circuit provided on a surface of the movable member, wherein:

the first conductive circuit is configured to electrically connect a first combination of one or more of the first terminals with the second terminal;

the second conductive circuit is configured to electrically connect a second combination of one or more of the first terminals with the second terminal; and the first combination is different from the second combination;

a film configured to slide relative to the heaters, the film including a first film surface in contact with at least one of the heaters;

a rotating body positioned to press a second film surface of the film and configured to be rotationally driven; and an actuator configured to rotate the movable member to selectively bring the first conductive circuit or the second conductive circuit into contact with the second terminal.

11. The fixing device of claim 10, wherein the first conductive circuit includes:

at least one third terminal configured to contact at least one of the first terminals;

a fourth terminal configured to contact the second terminal; and a conducting wire electrically connecting the at least one third terminal and the fourth terminal.

12. The fixing device of claim 10, wherein:

the first conductive circuit is configured to activate one or more of the heaters corresponding to a first shape of sheet on which an image is formed; and the second conductive circuit is configured to activate one or more of the heaters corresponding to a second shape of sheet on which an image is formed.

13. The fixing device of claim 10, further comprising:

a heating control circuit connected to a circuit including the plurality of first terminals, the second terminal, and the plurality of heaters.

14. The fixing device of claim 13, wherein the heating control circuit is provided between the second terminal and the power supply.

15. The fixing device of claim 10, wherein the movable member has a columnar shape.

* * * * *